US007020413B2

(12) United States Patent
Hatakeyama

(10) Patent No.: US 7,020,413 B2
(45) Date of Patent: Mar. 28, 2006

(54) LARGE CAPACITY PAPER FEEDING APPARATUS WITH A MOUNTING DEVICE THAT ALLOWS MOVEMENT OF A CASTER

(75) Inventor: Satoshi Hatakeyama, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 14 days.

(21) Appl. No.: 10/441,186

(22) Filed: May 20, 2003

(65) Prior Publication Data

US 2003/0218295 A1 Nov. 27, 2003

(30) Foreign Application Priority Data

May 21, 2002 (JP) ..... 2002-146176

(51) Int. Cl.
*G03G 15/00* (2006.01)

(52) U.S. Cl. ..... 399/107; 399/110; 399/393

(58) Field of Classification Search ..... 399/107, 399/110, 391, 393; 312/111; 271/157, 158; 414/396, 401, 467

See application file for complete search history.

(56) References Cited

U.S. PATENT DOCUMENTS 4,640,604 A * 2/1987 Kozuka et al. ..... 399/124
6,308,026 B1 * 10/2001 Kouchi ..... 399/110
6,466,753 B1 * 10/2002 Kida ..... 399/107

FOREIGN PATENT DOCUMENTS

JP 2000-15892 A 1/2000
JP 2001-222143 A 8/2001

* cited by examiner

*Primary Examiner*—William J. Royer
(74) *Attorney, Agent, or Firm*—Foley & Lardner LLP

(57) ABSTRACT

A large-capacity paper feeding apparatus includes a main unit which is to be mounted on one side of an image forming apparatus, is movable on a floor and is configured to feed paper sheets to the image forming apparatus, a caster which is provided at a bottom of the main unit and is to contact the floor to allow the main unit to move smoothly on the floor, and a mounting device which is moved to a first position to make the caster contact the floor and to a second position to retract the caster upward from the first position.

8 Claims, 5 Drawing Sheets

LARGE CAPACITY PAPER FEEDING APPARATUS WITH A MOUNTING DEVICE THAT ALLOWS MOVEMENT OF A CASTER

CROSS-REFERENCE TO RELATED APPLICATIONS

This application is based upon and claims the benefit of priority from Japanese Patent Application No. 2002-146176, filed May 21, 2002, the entire contents of which are incorporated herein by reference.

BACKGROUND OF THE INVENTION

1. Field of the Invention

The present invention relates to a large capacity paper feeding apparatus which continuously feeds a large quantity of paper to an electrophotographic copier, for example.

2. Description of the Related Art

A large capacity paper feeding apparatus of this type is removably mounted on the side of a copier, and feeds paper to the copier. This large capacity paper feeding apparatus is moved over the floor and mounted on the side of a copier. Casters are provided at the bottom of the apparatus to smooth the movement.

However, conventionally, casters are fixed to the bottom of a large capacity paper feeding apparatus, projecting downward from the bottom of the apparatus. This causes inconvenience when the floor inclines upward to the installation place of a copier, that is, the casters contact the floor, and the paper feeding apparatus inclines and smooth mounting fails.

BRIEF SUMMARY OF THE INVENTION

The present invention has been made to eliminate the above inconvenience. It is an object of the present invention to provide a large capacity paper feeding apparatus which can be smoothly mounted on an image forming apparatus even if the floor inclines upward to the installation place of the image forming apparatus.

According to a first embodiment of the present invention, there is provided a large-capacity paper feeding apparatus comprising a main unit which is to be mounted on one side of an image forming apparatus, is movable on a floor and is configured to feed paper sheets to the image forming apparatus; a caster which is provided at a bottom of the main unit and is to contact the floor to allow the main unit to move smoothly on the floor; and a mounting device which is moved to a first position to make the caster contact the floor and to a second position to retract the caster upward from the first position.

According to a second embodiment of the present invention, there is provided a large-capacity paper feeding apparatus comprising a support rail having one end portion which is to be secured to a bottom of an image forming apparatus, and another end portion which is to project horizontally and outwardly from the bottom of an image forming apparatus; a mounting table which is provided on the support rail; a main unit which is to be mounted on one side of the image forming apparatus, is movable on the mounting table and is configured to feed paper sheets to the image forming apparatus; a caster which is provided at a bottom of the main unit and is to contact the floor to allow the main unit to move smoothly on the mounting table; and a mounting device which is moved to a first position to make the caster contact the floor and to a second position to retract the caster upward from the first position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

The present invention will be explained hereinafter with reference to the embodiments shown in the attached drawings.

Figure 1:
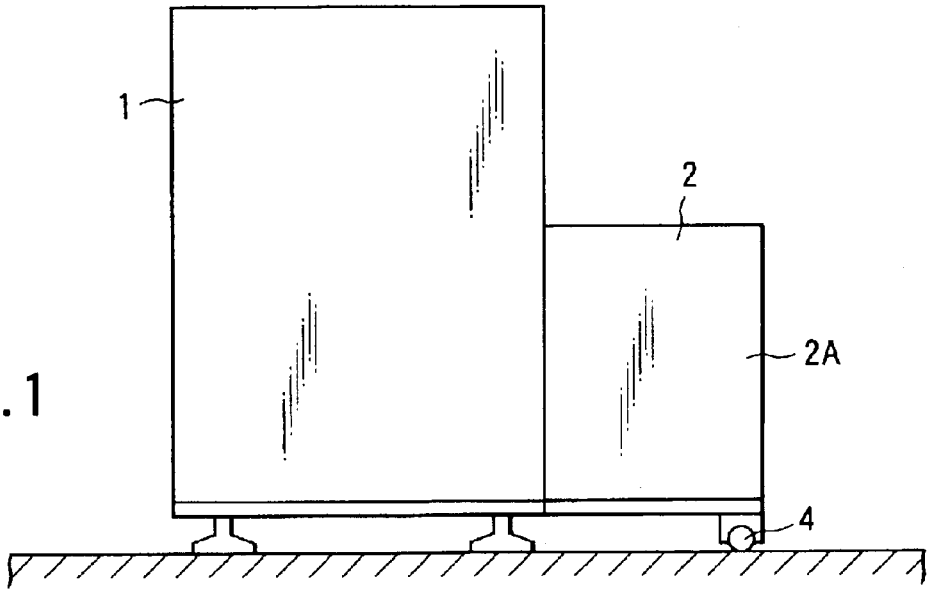
FIG. 1 is a front view showing an image forming apparatus and a large capacity paper feeding apparatus according to a first embodiment of the present invention.

FIG. 1 is a front view showing an electrophotographic copier as an image forming apparatus and a large capacity paper feeding apparatus according to a first embodiment of the present invention.

In the drawing, a reference numeral 1 denotes an electrophotographic copier. A large capacity paper feeding apparatus 2 is mounted on one side of the electrophotographic copier 1. The large capacity paper feeding apparatus 2 is provided with a main unit 2A. The main unit 2A contains a stack of about 4000 sheets of paper. A paper feeding mechanism (not shown) is provided in the main unit 2A, and supplies paper sheet by sheet to the electrophotographic copier 1.

A caster 4 is provided at the bottom of the main unit 2A to move the main unit 2A smoothly.

Figure 2:
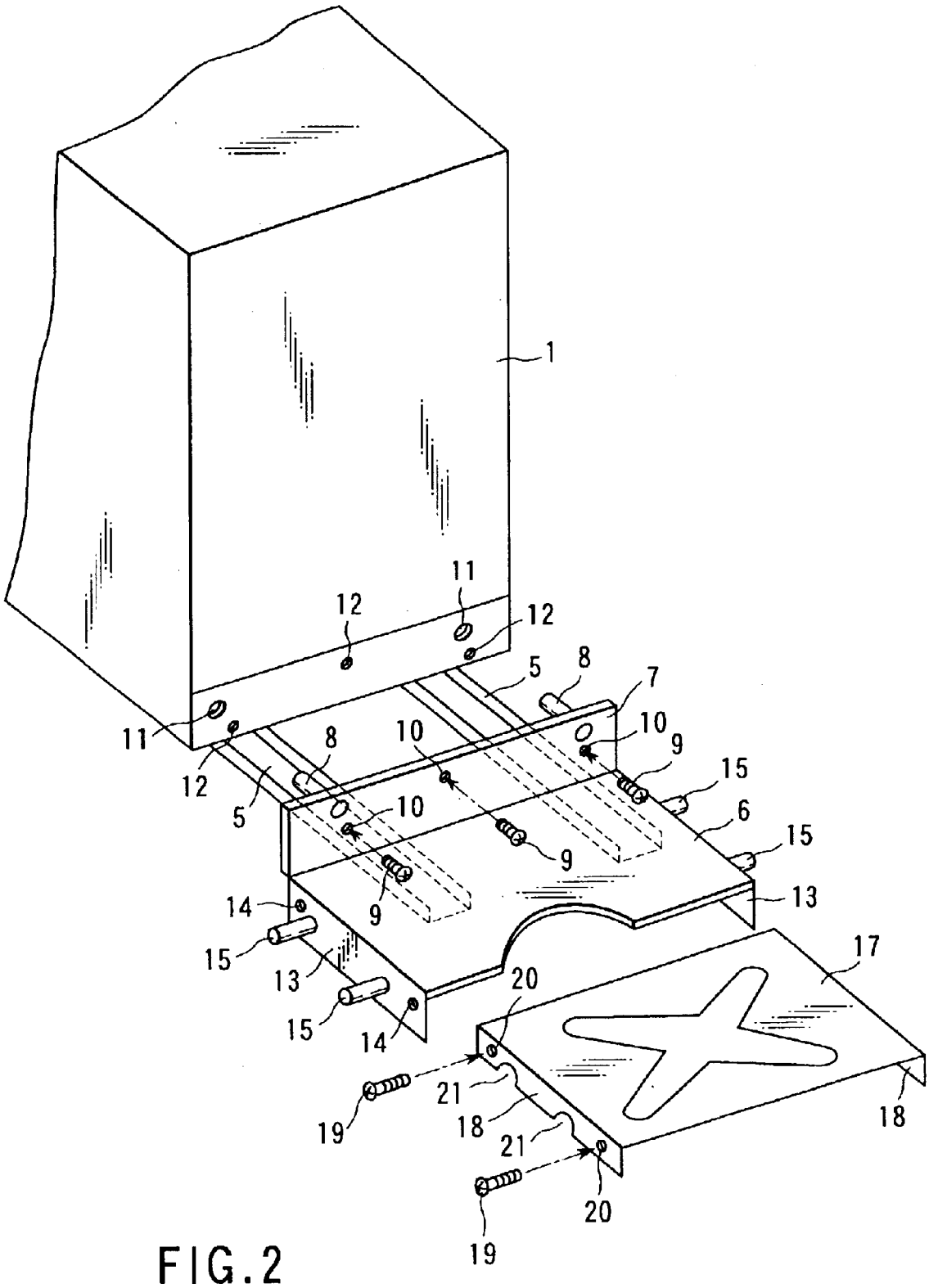
FIG. 2 is an exploded perspective view of a mounting part of the large capacity paper feeding apparatus of the same embodiment.

FIG. 2 is an exploded perspective view showing a mounting structure for the large capacity paper feeding apparatus 2.

A pair of U-shaped support rails 5/5 are provided at the bottom of the copier 1, on which a mounting table 6 is supported on the support rails 5/5. A stand piece 7 is welded to one side of the mounting table 6. Positioning pins 8/8 are provided projecting at both ends of one side of the stand piece 7. A plurality of through-holes 10 to insert a plurality of fixing screws 9 are made in the stand piece 7.

Positioning holes 11, 11 to insert the positioning pins 8/8 and screw holes 12 opposite to the through-holes 10 are made in the lower part of one side of the copier 1.

Bends 13 bending downward are formed at the front and rear ends of the mounting table 6. The bends 13 have screw holes 14 and positioning pins 15.

The mounting table 6 is supported on the support rails 5/5, and positioned by inserting the position pins 8/8 of the stand piece 7 into the positioning holes 11, 11 in the lower part of one side of the copier 1. The positioned mounting table 6 is fixed by inserting the fixing screws 9/9 into the screw holes 12, 12 in the lower part of one side of the copier 1, through the through-holes 10/10 of the stand piece 7.

A reference numeral 17 denotes a bottom unit to be fixed to the bottom of the main unit 2A of the paper feeding apparatus 2. Bends 18 bending downwardly are formed at the front and rear ends of the bottom unit 17. The bends 18 have screw holes 20 to pass through fixing screws 19 and concaves 21 to engage with the positioning pins 15.

The bottom unit 17 of the main unit 2A of the paper feeding apparatus 2 is placed and pushed on the mounting table 6, thereby the concaves 21 ends are engaged with the positioning pins 15/15 of the mounting table 6. After being positioned, the bottom unit 17 is fixed to the mounting table 6 with the fixing screws 19, 19 inserted into the screw holes 14, 14 through the screw holes 20, 20.

Figure 3:
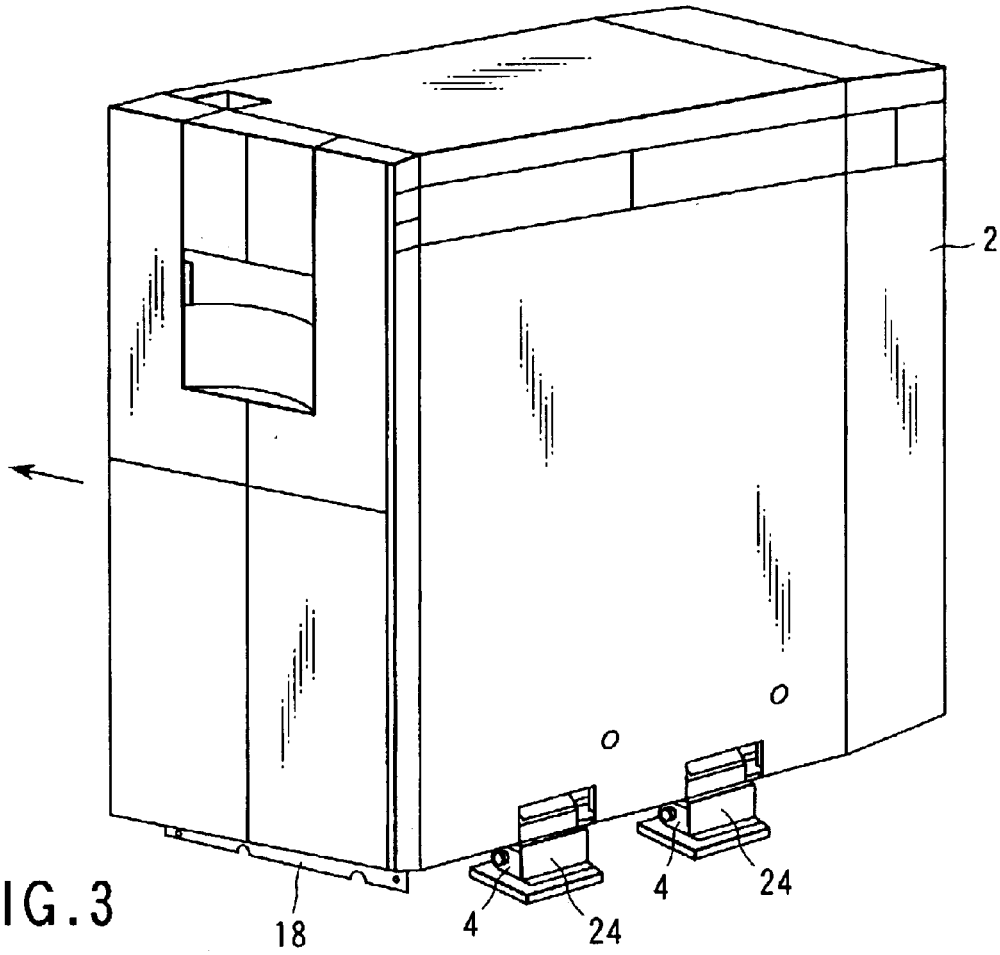
FIG. 3 is a perspective view showing the large capacity paper feeding apparatus of the same embodiment.
Figure 4:
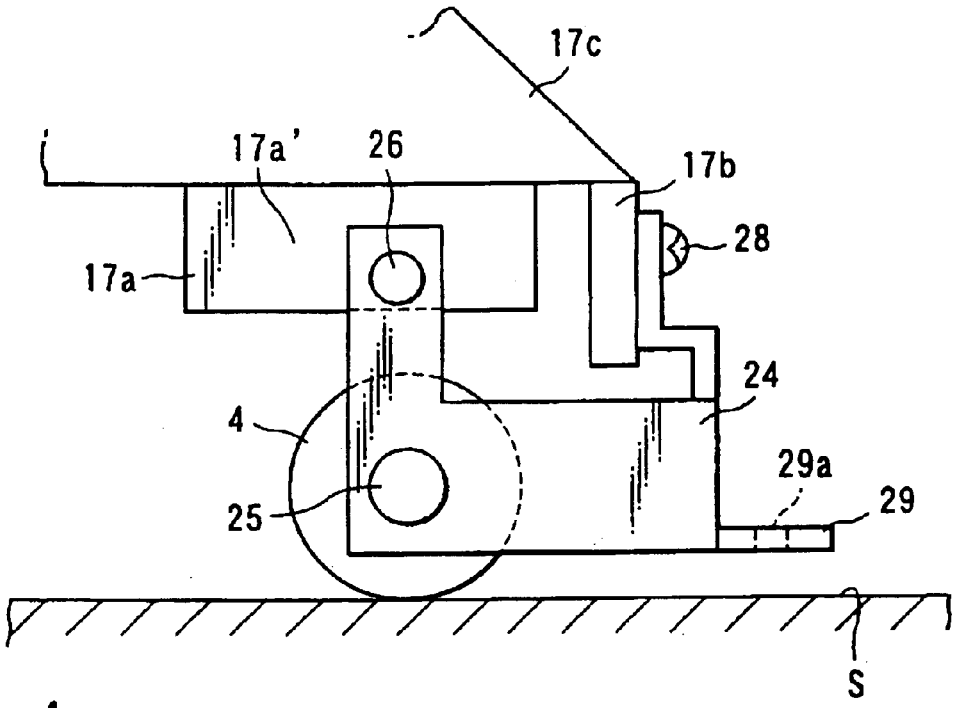
FIG. 4 is a front view showing a mounting structure for casters of the same embodiment.
Figure 5:
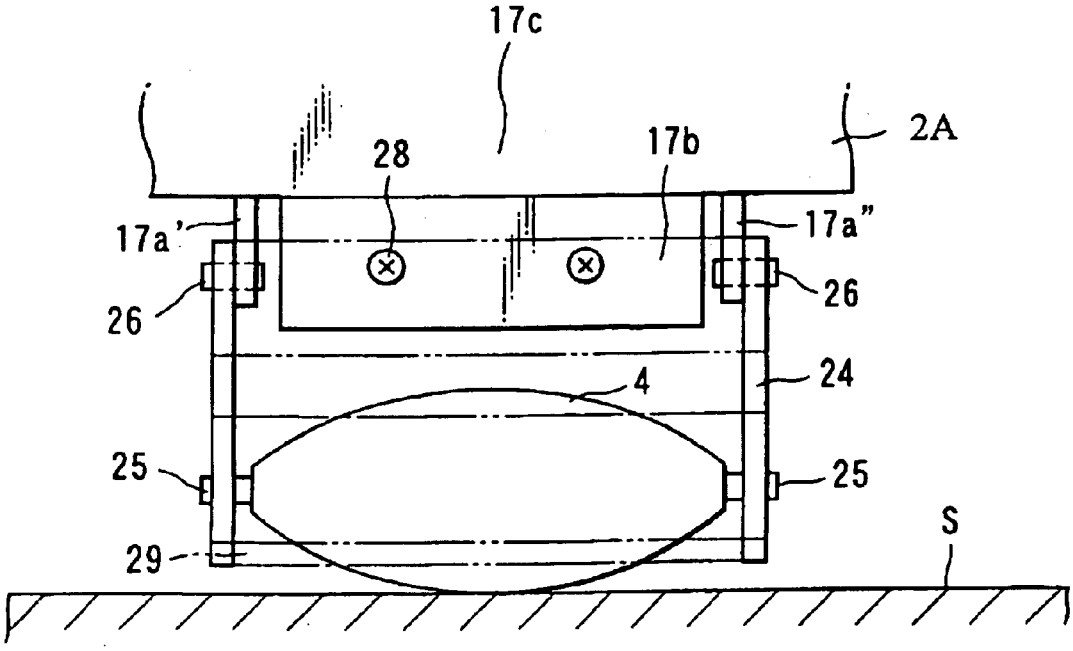
FIG. 5 is a side view showing the mounting structure of the casters of the same embodiment.

FIG. 3 is a perspective view showing the caster 4 fixed to the bottom of the main unit 2A of the paper feeding apparatus 2. FIG. 4 is a front view showing the mounting structure of the casters 4. FIG. 5 is a side view showing the mounting structure of the casters 4.

First to third support members 17*a*–17*c* are provided at the bottom of the main unit 2A of the paper feeding apparatus 2. The first support member 17*a* comprises a pair of support plates 17*a*', 17*a*" provided with a predetermined space therebetween, in the axial direction of the caster 4. The second support member 17*b* is provided between the support plates 17*a*' and 17*a*", along the axial direction of the caster 4. The third support member 17*c* forms an inclined plane with an inclination angle of about 45 degrees.

The caster 4 is rotatably fixed to a bracket 24 through a rotary axle 25. The bracket 24 is revolvably fixed to the pair of support plates 17*a*', 17*a*" of the first support member 17*a* through a rotary axle 26, and the upper side of the revolving end is fixed with a fixing screw 28 to the second support member 17*b*.

A horizontal projection 29 is formed in the lower part of the revolving end of the bracket 24. An insertion port 29*a*, described later, to insert a screw driver or the like, is made in the projection 29. The caster 4 is made in a spindle shape as shown in FIG. 5.

Next, a procedure of mounting the large capacity paper feeding apparatus 2 will be explained with reference to FIG. 6 to FIG. 9.

Figure 6:
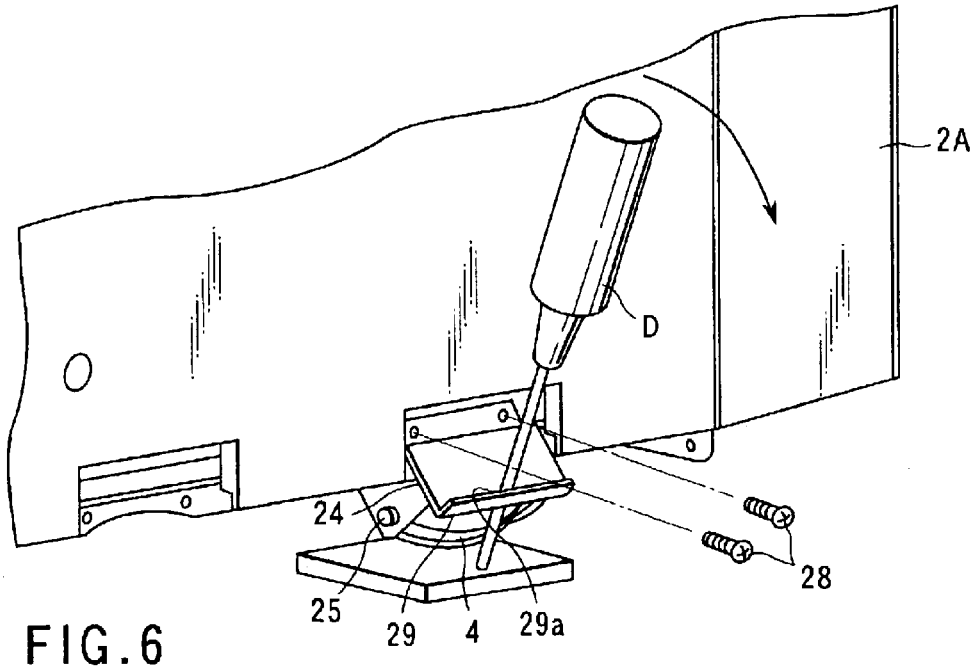
FIG. 6 is a perspective view showing the state when moving the casters of the same embodiment from a safety position to a paper feeding position.
Figure 7:
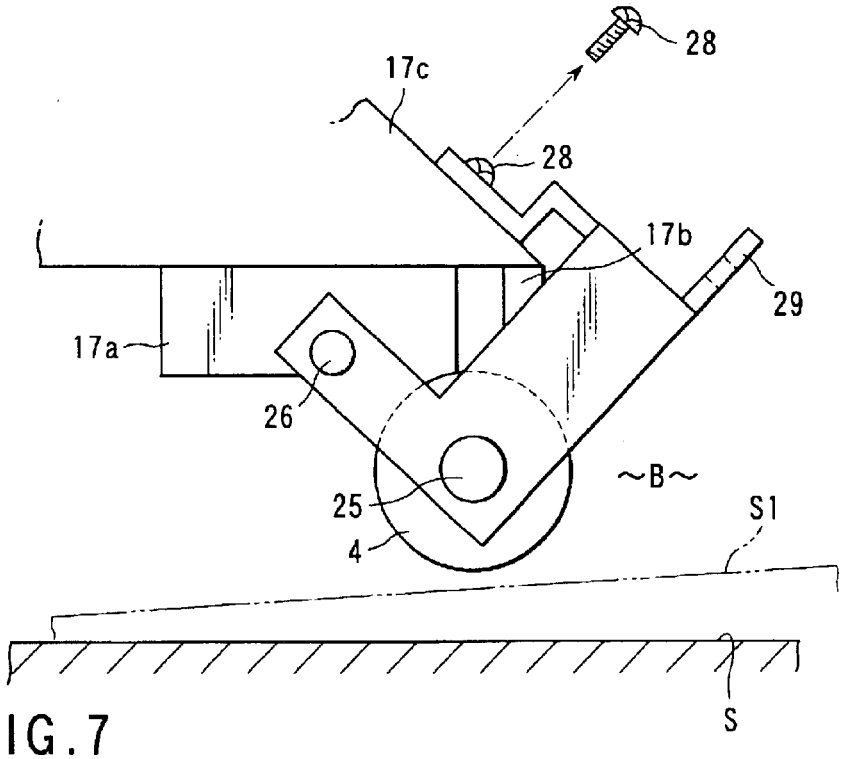
FIG. 7 is a front view showing a state where the casters of the same embodiment are moved to the safety position.

First, before the caster 4 is fixed to the large capacity paper feeding apparatus 2, the bracket 24 is turned 45 degrees upward, and the upper side of the revolving end is fixed to the third support member 17*c* with the fixing screw 28, as shown in FIG. 6 and FIG. 7. That is, the caster 4 is retracted to a safety position B (the second position). With the caster 4 retracted upward, the large capacity paper feeding apparatus 2 is placed on the mounting table 6, moved toward the copier 1 and loaded into one side of the copier 1.

Figure 8:
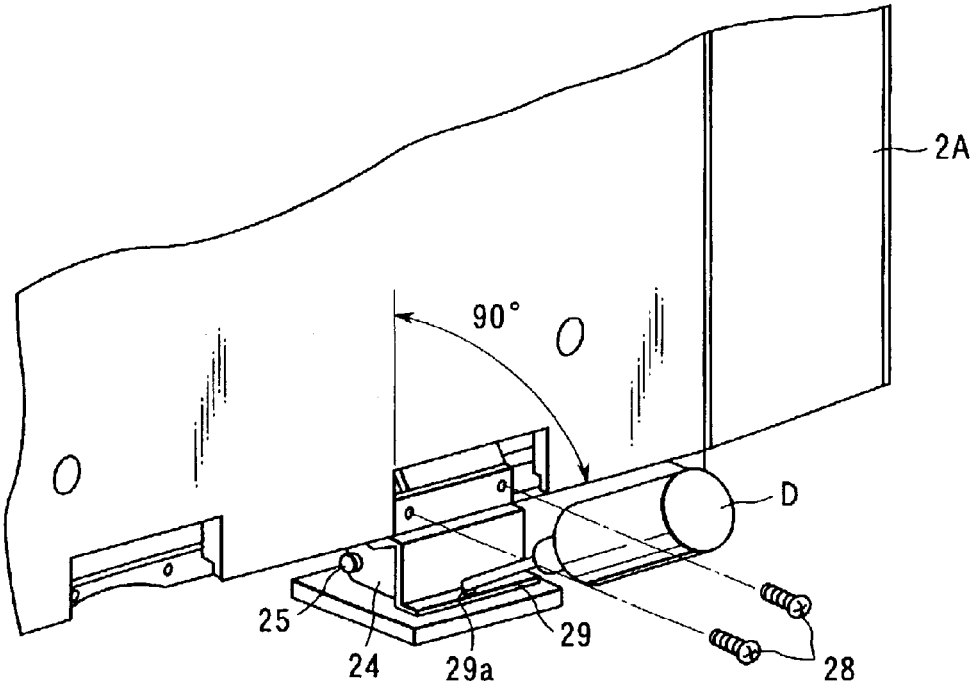
FIG. 8 is a perspective view showing a state where the casters of the same embodiment are moved to the bottom of the paper feeding apparatus.
Figure 9:
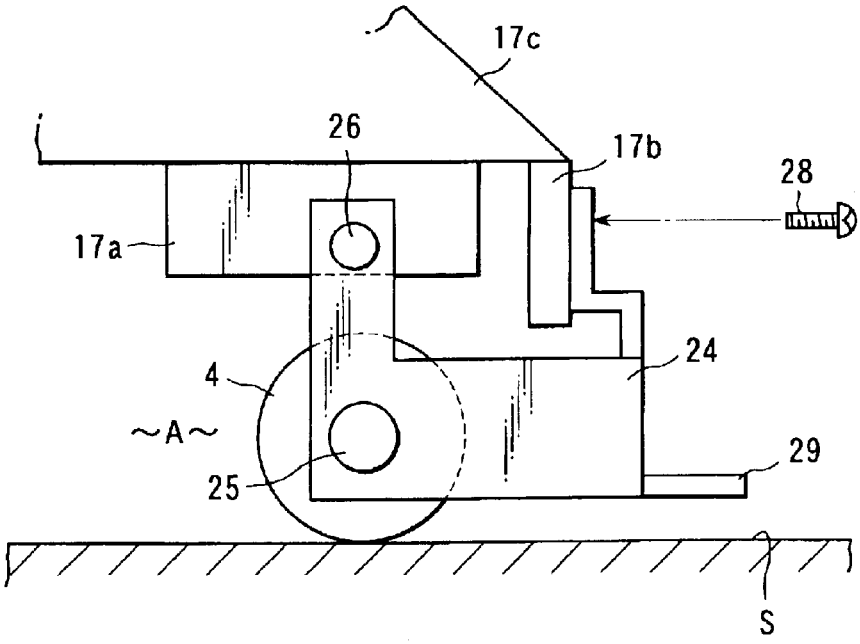
FIG. 9 is a front view showing a state where the casters of the same embodiment are moved to the bottom of the paper feeding apparatus.

After the large capacity paper feeding apparatus 2 is loaded, the fixing screw 28 of the bracket 24 is removed. Then, a screwdriver D is inserted into the insertion port 29*a* of the projection 29 of the bracket 24 of the caster 4, and moved downwards, as shown in FIG. 8, or the bracket 24 is moved downward by stepping on projection 29. The upper end of the revolving end of the bracket 24 joins the second support member 17*b*, and the caster 4 moves toward the position A (the first position) on the bottom of the large capacity paper feeding apparatus 2, and contacts the floor S, as shown in FIG. 9. The upper end of the revolving end of the bracket 24 is fixed to the second support member 17*b* with the fixing screw 28. This completes the mounting.

As explained above, before the large capacity paper feeding apparatus 2 is mounted, the caster 4 is retracted to the upper safety position B (the second position), and the caster 4 does not contact the inclined plane S1 even if the floor S is inclined like the inclined plane S1 in FIG. 7. Thus, the large capacity paper feeding apparatus 2 is not inclined, and can be mounted on one side of the copier 1 by smoothly moving on the mounting table 6.

Further, the caster 4 is made in a spindle shape, and only a point of the lower side of the middle of the caster 4 contacts the floor S. Therefore, the friction resistance of the caster 4 is small, enabling smooth movement of the large capacity paper feeding apparatus 2 in the axial direction of the caster 4.

The present invention is not limited to the above described embodiments, and is modifiable within the basic concept of the present invention as described above.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A large-capacity paper feeding apparatus comprising:

a main unit which is to be mounted on one side of an image forming apparatus, is movable on a floor and is configured to feed paper sheets to the image forming apparatus;

a caster which is provided at a bottom of the main unit and is to contact the floor to allow the main unit to move smoothly on the floor; and a mounting device which is moved to a first position to make the caster contact the floor and to a second position to retract the caster upward from the first position, wherein the mounting device is rotatable, and wherein the mounting device has a bracket to support the caster, allowing the caster to rotate, the bracket being rotatable by 45 degrees between the first position and the second position.

2. The large-capacity paper feeding apparatus according to claim 1, wherein the caster is shaped like a spindle.

3. A large-capacity paper feeding apparatus comprising:

a support rail having one end portion which is to be secured to a bottom of an image forming apparatus, and another end portion which is to project horizontally and outwardly from the bottom of the image forming apparatus;

a mounting table which is provided on the support rail;

a main unit which is to be mounted on one side of the image forming apparatus, is movable on the mounting table and is configured to feed paper sheets to the image forming apparatus;

a caster which is provided at a bottom of the main unit and is to contact a floor to allow the main unit to move smoothly on the mounting table; and a mounting device which is moved to a first position to make the caster contact the floor and to a second position to retract the caster upward from the first position.

4. A caster device comprising:

a movable member which is movable on a floor;

a bracket which is rotatably provided on a bottom plate of the movable member;

a caster which is rotatably supported by the bracket, the caster coming into contact with the floor when the bracket is rotated in a first direction, the caster being retracted upward from the floor when the bracket is rotated by a predetermined angle in a second direction opposite to the first direction.

5. The caster device according to claim 4, wherein the bracket comprises a force exerted portion on which a force to rotate the bracket in the first direction is exerted.

6. The caster device according to claim 4, wherein the predetermined angle by which the bracket is rotated is 45 degrees.

7. The caster device according to claim 4, wherein the bracket is fixed by a fixing member at a first position of the movable member when the caster is in contact with the floor, and the bracket is fixed by the member at a second position of the movable member when the caster is retracted from the floor.

8. The caster device according to claim 4, wherein the caster is shaped like a spindle.

* * * * *